US007118788B1

(12) United States Patent
Turner et al.

(10) Patent No.: US 7,118,788 B1
(45) Date of Patent: Oct. 10, 2006

(54) ARTIFICIAL SAGUARO CACTUS

(75) Inventors: O. Richard Turner, Benton, KS (US); Eric J. Carroll, Valley Center, KS (US)

(73) Assignee: Desert Steel Company, Wichita, KS (US)

( * ) Notice: Subject to any disclaimer, the term of this patent is extended or adjusted under 35 U.S.C. 154(b) by 254 days.

(21) Appl. No.: 10/753,540

(22) Filed: Jan. 8, 2004

(51) Int. Cl.
*A41G 1/00* (2006.01)

(52) U.S. Cl. ..... 428/17; 428/18

(58) Field of Classification Search ..... 47/20.1, 47/22.1, 23.1, 23.2, 25.1, 29.5, 29.6, 30, 47/3; D11/63, 64, 117, 118, 124, 130.1, D11/139, 184; 428/7, 8, 9, 15, 12, 18, 17, 428/19, 20, 21, 23, 27
See application file for complete search history.

(56) References Cited

U.S. PATENT DOCUMENTS 1,656,310 A * 1/1928 Anderson ..... 428/8
2,186,351 A * 1/1940 Stojaneck ..... 428/7
3,829,349 A * 8/1974 Hermanson ..... 428/8
5,213,855 A 5/1993 Buxton
6,343,440 B1 2/2002 Ayers
D477,546 S 7/2003 Como
2004/0001923 A1* 1/2004 Kao ..... 428/18

OTHER PUBLICATIONS

Websites-www.mainlandmart.com/cactus.html Sep. 21, 2005.*

* cited by examiner

*Primary Examiner*—Jennifer Mcneil
*Assistant Examiner*—Gordon R. Baldwin
(74) *Attorney, Agent, or Firm*—Kenneth H. Jack; Davis & Jack, L.L.C.

(57) ABSTRACT

An artificial saguaro cactus having a cactus trunk indicating section having an annular wall; a multiplicity of apertures extending through the annular wall, the apertures being arranged in a plurality of vertically extending series, the annular wall being alternately inwardly and outwardly creased along the vertically extending series of apertures, the creases vertically pleating the inner and outer surfaces of the annular wall; a domed cap fitted for covering the upper end of the annular wall; and cap attaching means interconnecting the domed cap and the upper end of the annular wall.

18 Claims, 5 Drawing Sheets

ARTIFICIAL SAGUARO CACTUS

FIELD OF THE INVENTION

This invention relates to structural apparatus and assemblies adapted for portraying or suggesting in three dimensions the appearance of a natural plant. More particularly, this invention relates to such apparatus and assemblies which are adapted for portraying or suggesting the appearance of cactuses.

BACKGROUND OF THE INVENTION

The externally visible surface characteristics of natural saguaro cactuses are geometrically complex. Such cactuses include a vertically ribbed or pleated trunk which slightly flares upwardly from its lower end and which slightly flares downwardly from its upper end. Older natural saguaro cactuses are further geometrically complicated, including upturned and laterally extending arms or branches, the arms being, similarly with the trunk, vertically pleated or ribbed. Such arms typically slightly flare downwardly from their upper or distal ends, and such arms typically elbow or arcuately curve toward the trunk and connect to the trunk at their lower or proximal ends.

Such complicated geometric surface features of natural saguaro cactuses result in complexities and cause difficulties in fabricating and assembling structures to accurately depict or portray such cactuses in three dimensions. Where, for example, heavy gauge sheet metal material is utilized in the fabrication of an artificial saguaro cactus, difficulties arise in vertically pleating or ribbing the sheet material. Further difficulties arise where sheet metal arms are added to such cactus, requiring that the pleated or ribbed texture follow an arcuately curved elbow at the proximal end of the arm.

The instant inventive artificial saguaro cactus solves or ameliorates problems noted above by providing unique and novel structures applicable to sheet metal material construction, such structures providing assistance in vertically pleating or ribbing the sheet metal material, and such structures allowing such pleats or ribs to follow the arcuate or elbowed curves at the proximal arm ends for portraying elbowed saguaro cactus arms.

BRIEF SUMMARY OF THE INVENTION

A major structural component of the instant inventive artificial saguaro cactus comprises a vertically extending cactus trunk indicating column. Preferably, such column is hollow bored and comprises a sheet metal skin layer, the sheet metal preferably comprising galvanized sheet steel. The sheet metal skin of such cactus trunk indicating column preferably comprises an annular wall formed of the steel sheet, such wall having upper and lower ends, and having inner and outer surfaces. While the annular wall of such cactus trunk indicating column may suitably comprise a single metal sheet which is circularly arcuately curved through 360°, such sheet is preferably vertically segmented, comprising a pair of vertically joined sheets, each sheet being semi-circularly arcuately curved through 180°.

The cactus trunk indicating column's annular wall preferably comprises a multiplicity of pleat assisting apertures extending therethrough, the apertures preferably being arranged in a plurality of vertically extending series. The series of pleat assisting apertures allow the annular wall to be manually inwardly and outwardly creased along the vertical series of apertures so that the creases vertically pleat the annular wall. In addition, to assisting in the process of vertical pleating, the vertically extending series of apertures advantageously portray surfaces textures features such as spines or dark crevices which are common features of natural saguaro cactuses. The annular wall's vertical pleats serve the function of depicting or portraying the vertically extending ribs which are also common to natural saguaro cactuses.

Preferably, each aperture among the vertically extending series of apertures is vertically oblongated forming a pleating slot, each such slot being between two inches and three inches in vertical length. Preferably, the upper and lower ends of each slot are vertically spaced approximately one-half inch away from successive slots above and below, providing a vertically extending series of short bending zones. Manual vertical creasing of the metal preferably occurs at the approximate one-half inch bend zones which vertically separate the oblongated apertures or slots. The combined function of the vertical series of bend zones and slots is reduction of the torsional bending pressure needed for manual creasing and pleating.

Natural saguaro cactuses typically have domed shaped upper trunk and arm ends. Accordingly, a domed cap indicating structure is preferably provided along with cap attaching means interconnecting such structure and the upper ends of the trunk's and arm's annular walls. Preferably, the domed cap indicating structure comprise a pluralities of pointed fingers fixedly attached to or formed wholly with the upper ends of the annular walls, such fingers being arcuately curved so that they extend upwardly and inwardly. Such arcuately curved fingers advantageously suggest or portray both domed upper ends and portray pleating or ribbing over such upper ends.

Natural saguaro cactuses commonly slightly flare upwardly from their lower ends to a maximum circular diameter, and thereafter slightly taper inwardly from such maximum diameter to the cactus trunk's upper end. In order to cause the annular wall of the instant inventive artificial saguaro cactus to depict or portray such trunk flaring and tapering, the annular wall preferably is divided into joined upper and lower sections, the lower section flaring upwardly from its lower end, and the upper section flaring downwardly from its upper end. In order to facilitate such flaring, metal sheets from which the annular wall sections are annularly formed are preferably initially substantially trapezoidally shaped.

The instant inventive cactus is preferably rigidly internally supported such support is preferably provided via welded internal cross braces which are preferably disc or ring shaped. The cross bracing discs preferably have outwardly extending "V" shaped pleat supporting points which are preferably welded to the inner surfaces of the vertically paired faces of the annular wall's pleats or ribs. The cross braces are preferably vertically spaced along the vertical lengths of the hollow interior bores of the annular walls of the trunk and arm sections.

As indicated above, it is desirable to attach one or more saguaro cactus arms depicting members to the instant invention's trunk depicting member. Such cactus arms are preferably constructed and fabricated similarly with the trunk structure described above. However, it may be noted that the lower or proximal end of a natural saguaro cactus arm both pleated or ribbed and is arcuately curved or elbowed. The process of straight line creasing or pleating of metal sheets, as described above, is not readily compatible with fabrication of elbow surfaces which are both curved and ribbed or pleated.

In order to allow vertically paired rib forming pleat faces to follow the arcuately curved or elbowed proximal end of a saguaro cactus arm depicting member, the lower end of such member's annular wall preferably comprises a plurality of downwardly extending and arcuately curved fingers or pleat face strips. Preferably, the pleat face strips or fingers are arranged about the periphery of the lower end of such arm's annular wall so that pleat face gaps are defined between such strips, such gaps alternating with the pleat face strips.

Upon vertical creasing and pleating of the upper non-elbowed end of the artificial saguaro cactus arm's annular wall, and upon annular or circular curving such wall about a vertical axis, the arcuately curved pleat face strips are caused to extend along the properly curving paths, forming intermittent arcuately curved or elbowed pleat faces. A separately attachable plurality of arcuately curved pleat face strips are preferably fixedly welded to first plurality of pleat face strips. Lateral sides of said pluralities of pleat face strips are preferably welded together so that the strips among such separately attachable plurality cover and fill the pleat face gaps. Upon such filling and closure of the pleat face gaps, pleating or ribbing of the elbowed portion of the arm is accomplished.

Upon completed fabrication of a saguaro cactus arm depicting member as described above, the extreme proximal end of such arm is preferably fixedly welded to the side wall of the saguaro cactus trunk depicting member, completing construction of the inventive artificial saguaro cactus. Suitably, multiple arms, each fabricated as described above, may be attached to the cactus trunk member.

Preferably, the elbowed arms of the artificial saguaro cactus as described above are internally braced similarly with the trunk, as described above, and preferably domed shaped upper or distal ends of such arms are configured similarly with the upper ends of the trunks, as described above.

Accordingly, it is an object of the instant invention to provide an artificial saguaro cactus incorporating vertically pleated annular wall sections, the vertical pleats being bordered and defined by vertically extending series of apertures.

It is a further object of the present invention to provide such an artificial saguaro cactus further comprising at least a first vertically pleated cactus arm having an annular wall, the annular wall having a lower end, the lower end comprising downwardly extending an arcuately curved pleat face strips, such pleat face strips defining an alternating series of pleat face gaps, the pleat face gaps being filled by a second plurality of arcuately curved pleat face strips.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
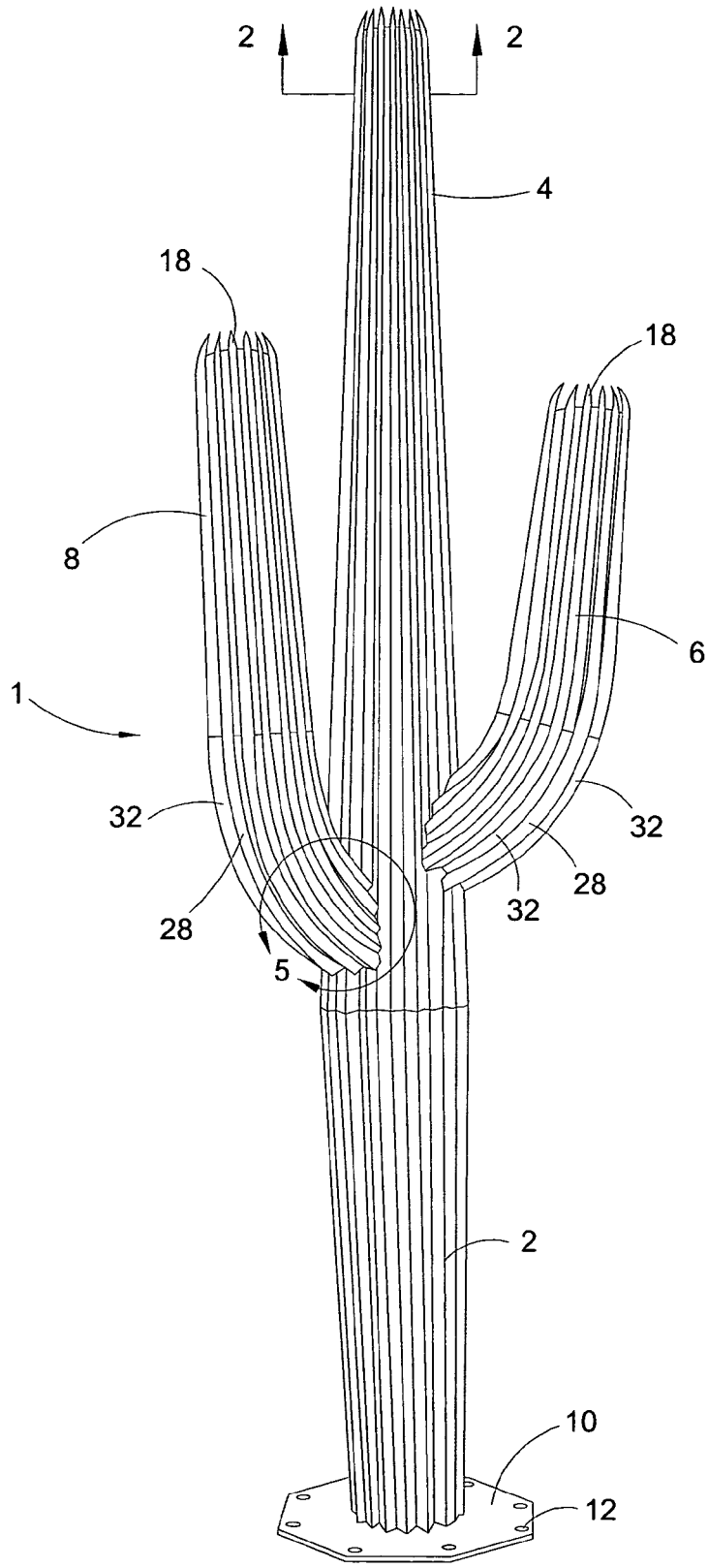
FIG. 1 is a front view of the instant inventive artificial saguaro cactus.

Referring now to the drawings, and in particular to FIG. 1, the instant inventive artificial saguaro cactus is referred to generally by Reference Arrow 1. The artificial saguaro cactus 1 preferably comprises a slightly upwardly flared lower section 2, and a slightly downwardly flared upper section 4. Also, such artificial cactus preferably has at least a first, and preferably a pair of downwardly flared elbowed arms 6 and 8. Suitably, arms 6 and 8 may be omitted or the number of arms may differ.

Referring further to FIG. 1, pointed fingers 18 which extend upwardly from the upper or distal ends of arms 6 and 8, and which similarly extend upwardly and inwardly from the extreme upper end of the upper truck section 4 function to suggest or depict domed shaped and ribbed upper ends which are common to natural saguaro cactuses. A base mounting plate 10 having mounting bolt receiving apertures 12 is preferably fixedly welded to the lower end of lower section 2.

Figure 2:
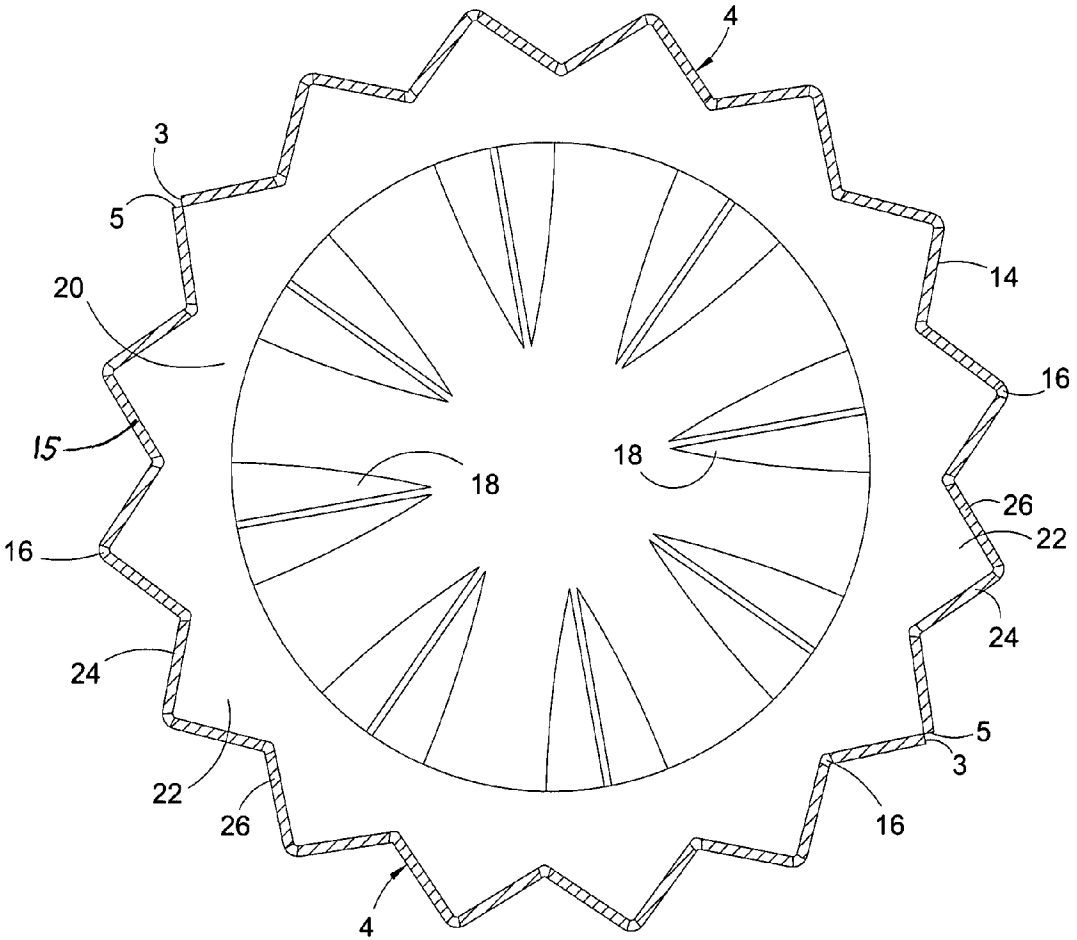
FIG. 2 is a sectional view of the artificial cactus of FIG. 1, as indicated in FIG. 1.

Referring simultaneously to FIGS. 1 and 2, the upper trunk section 4 of the artificial saguaro cactus 1 preferably comprises a pair of semi-circular vertically pleated plates 14 and 15. Suitably, a single 360° curved plate, each such plate 14 and 15 having left and right ends 3 and 5 which meet those of the other plate, the paired semi-circular plates cumulatively forming the trunk sections annular wall.

Figure 3:
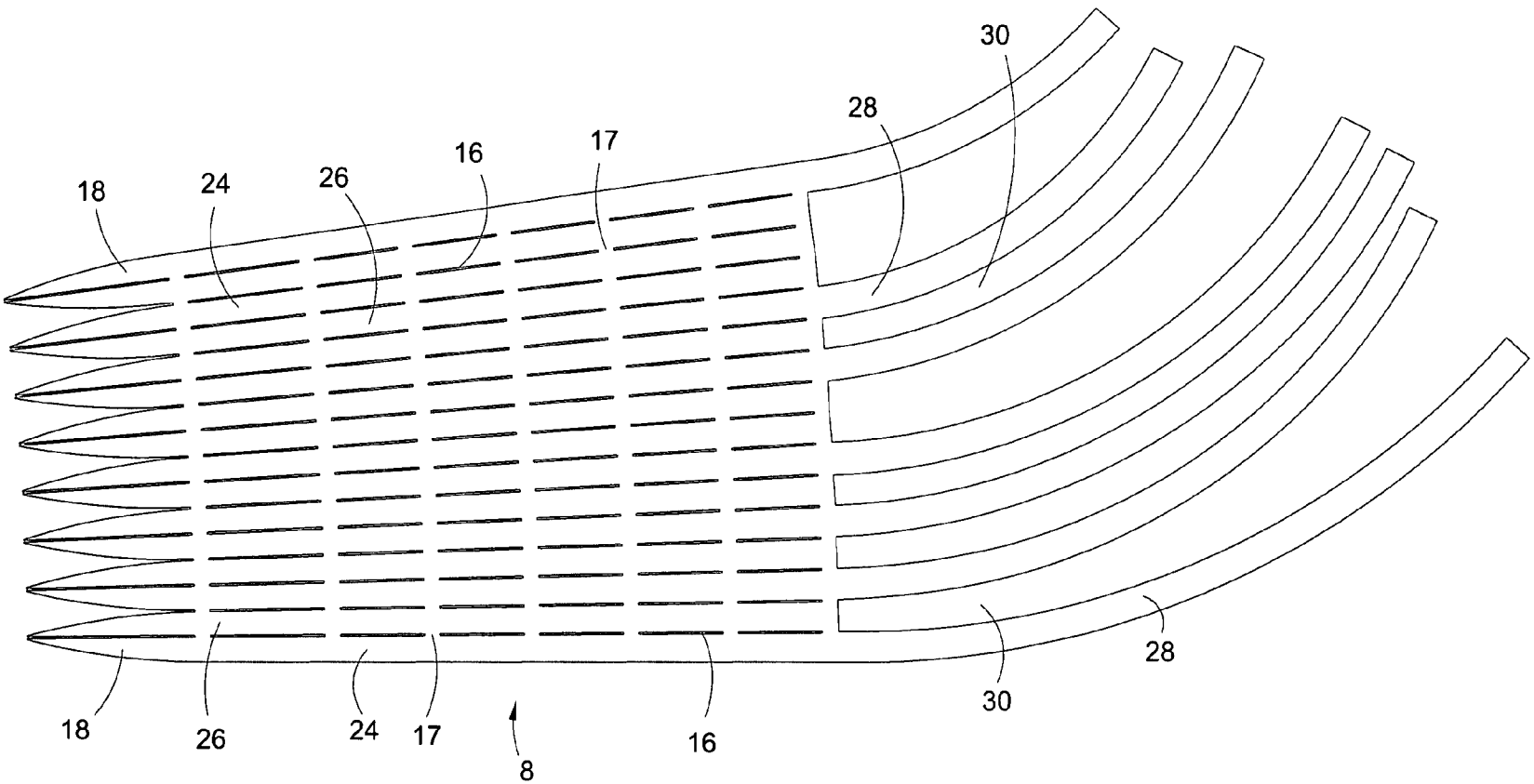
FIG. 3 depicts a saguaro cactus arm metal sheet component prior to introduction of arcuate curvature and vertical pleating.

Referring simultaneously to FIGS. 1, 2, and 3, each of the vertically extending ribs of sections 2 and 4 and each of the ribs of arms 6 and 8 comprise paired parallel and vertically extending pleat faces 24 and 26. Circular ring braces 20 are preferably fixedly welded to the pleated inner surfaces of the annular walls of sections 2 and 4 and of arms 6 and 8, the braces 20 preferably having outwardly extending pleat supporting "V" shaped points 22. The inner surfaces of the vertically extending pleats or ribs of such trunk sections and arms are preferably fixedly welded to the pleat supporting points 22.

Figure 5:
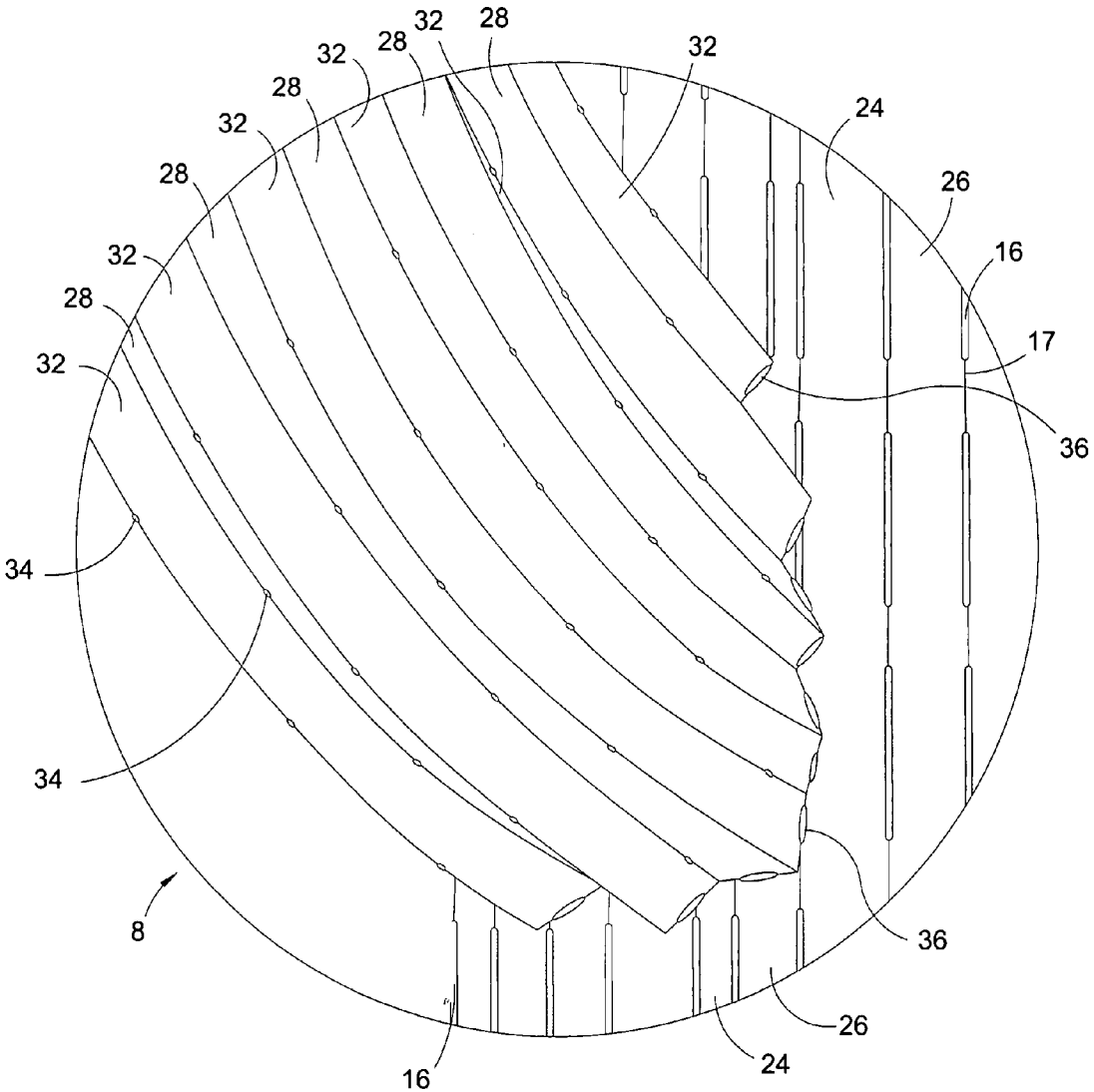
FIG. 5 is a magnified partial view of the artificial cactus of FIG. 1, as indicated in FIG. 1.

Referring simultaneously to FIGS. 1, 2, and 5, a plurality of vertically extending series of vertically oblongated slots 16 extend through the annular walls of sections 2 and 4, and extend through the annular walls of arms 6 and 8, such slots primarily serving the function of assisting in creasing and pleating such walls by providing vertically extending series of bend zones or sections 17 successively positioned between the upper and lower ends of oblongated slots 16.

Referring again to FIG. 1, the lower trunk section 2 is configured similarly with the upper section of the trunk 4, the lower end of the upper section 4, preferably being fixedly welded to the upper end of the lower section 2.

Referring to FIG. 3, a flat steel plate is depicted, such plate representing, referring further simultaneously to FIG. 1, a basic structural element of a semi-circular half section of arm 8. In fabricating the upper end of arm 8, pleat faces 24 and 26 are alternately inwardly and outwardly creased along the vertically extending series of oblongated slots 16, and along the alternating vertically extending series of bend zones 17. Such vertical pleating effectively portrays the vertical cactus arm ribs depicted in FIG. 1. Referring further simultaneously to FIG. 2, ring shaped internal braces similar to brace 20 having outwardly extending pleat supporting points 22 are preferably welded to the inner arcuately curved surface of the plate depicted in FIG. 3.

Figure 4:
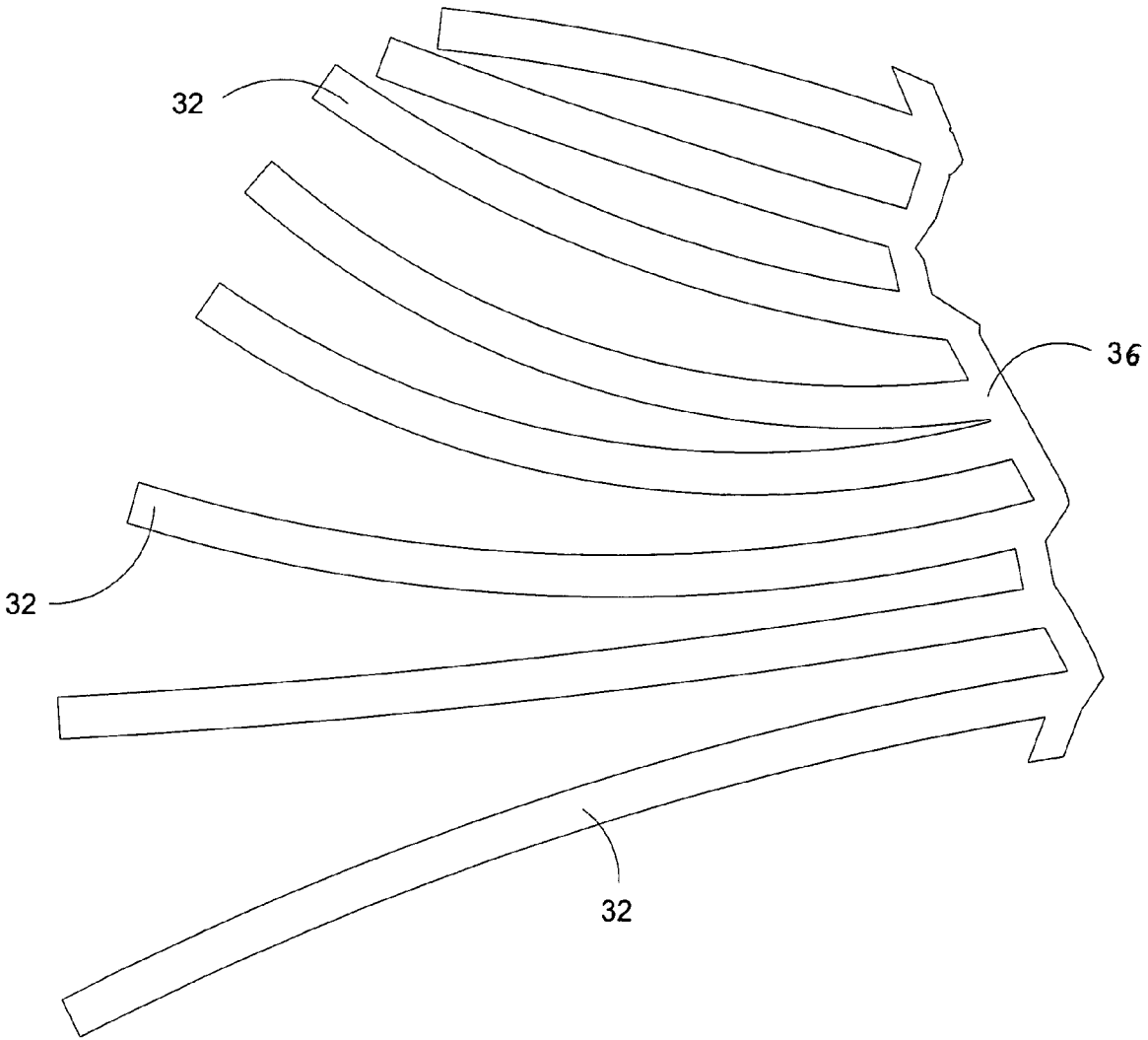
FIG. 4 depicts arcuately curved gap filling pleat face strips.

Referring again to FIG. 3, the above described process of vertically creasing and pleating the upper end of arm 8 necessarily rotates the upper ends of pleat face strips 28, such strips extending downwardly from the lower end of the depicted metal plate. Referring further to FIG. 1, the curved pleat face strips 28 partially form the lower or proximal elbowed portion of arm 8. In order to prevent interference and misdirection of the pleat face strips 28, such strips are arranged preferably to border and define an alternating series of pleat face gaps 30. Referring further simultaneously to FIG. 4, a second plurality of separately attachable pleat face strips 32 is provided, such strips 32 preferably being temporarily interconnected for purposes of sheet cutting and handling by a connector strip 36. In the process of fabrication, pleat face strips 32 are trimmed away from connector strip 36.

Referring simultaneously to FIGS. 1, 3, 4, and 5, the lateral sides of the separately attachable pleat face strips 32 are attached by welds 34 to the lateral sides of pleat face strips 28, such welded attachments of pleat face strips 32 spanning across and filling the pleat face gaps 30. Upon accomplishment of such welded attachments of pleat face strips 32, across pleat face gaps 30, the proximal or elbowed end of cactus arm 8 is formed. Thereafter, the extreme proximal end of such arm is preferably fixedly attached to the side wall of the upper trunk section 4 by welds 36.

Referring to FIG. 3, the lateral left end (or lower end according to the view of the drawing) of the depicted metal plate may suitably represent a vertical midline of a wider sheet intended to accommodate 360° of curvature as opposed to the 180° curvature which is accommodated by the sheet depicted. Where a double width 360° curvature sheet is provided, pleat face strips 28 which are positioned rightwardly from such midline preferably are rightwardly curved, and such strips which are positioned leftwardly of such midline preferably oppositely leftwardly curved.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. An artificial saguaro cactus comprising:

(a) a cactus trunk indicating column comprising an annular wall, having upper and lower ends, and having inner and outer surfaces;

(b) a multiplicity of pleat assisting apertures extending through the annular wall, the pleat assisting apertures being arranged in a plurality of vertically extending series, the annular wall being alternately inwardly and outwardly creased along the vertically extending series of pleat assisting apertures, the creases vertically pleating the annular wall;

(c) a domed cap fitted for covering the upper end of the annular wall;

(d) cap attaching means interconnecting the domed cap and the upper end of the annular wall.

2. The artificial saguaro cactus of claim 1 wherein each aperture among the multiplicity of pleat assisting apertures is vertically oblongated.

3. The artificial saguaro cactus of claim 2 wherein the domed cap comprises a plurality of upwardly extending and inwardly curving fingers.

4. The artificial saguaro cactus of claim 3 wherein the cactus trunk indicating column comprises an upwardly flared lower section and a downwardly flared upper section.

5. The artificial saguaro cactus of claim 4 further comprising a plurality of braces rigidly supporting the annular wall's inner surface.

6. The artificial saguaro cactus of claim 5 wherein each brace comprises a plurality of outwardly extending pleat supporting points.

7. The artificial saguaro cactus of claim 6 further comprising a base fixedly attached to the cactus trunk indicating column's section's lower end.

8. The artificial saguaro cactus of claim 7 wherein the annular wall and the braces comprise metal, and wherein the pleat supporting points are welded to the annular wall's inner surface.

9. The artificial saguaro cactus of claim 8 wherein the base's fixed attachment comprises welds.

10. An artificial saguaro cactus comprising:

(a) at least a first cactus arm sheet having an inner side, an outer side, a left end, a right end, a distal end, a proximal end, and having a vertical mid-line, the proximal end of the cactus arm sheet comprising a first plurality of arcuately curved pleat face strips;

(b) a multiplicity of apertures extending through the at least first cactus arm sheet, the apertures being arranged in a plurality of vertically extending series defining a plurality of vertically extending pleat faces, the first plurality of arcuately curved pleat face strips being positioned so that each such strip underlies one of the pleat faces, and further positioned to define a plurality of pleat face gaps, each pleat face gap underlying one of the vertically extending pleat faces, the at least first cactus arm sheet being alternately inwardly and outwardly creased along the vertically extending series of apertures, the creases vertically pleating the at least first cactus arm sheet, said sheet being annularly curved so that its left end meets its right end;

(c) a second plurality of arcuately curved pleat face strips fixedly attached to the first plurality of arcuately curved pleat face strips, the second plurality of extending and arcuately curved pleat face strips covering the pleat face gaps; and, (d) a saguaro cactus trunk indicating column having a side wall, the proximal end of the at least first cactus arm sheet being fixedly attached to said side wall.

11. The artificial saguaro cactus of claim 10 wherein the at least first cactus arm sheet comprises left and right sections respectively having right and left ends, the right and left ends of the left and right sections meeting at the vertical mid-line.

12. The artificial saguaro cactus of claim 11 wherein the distal end of the at least first cactus arm sheet comprises a plurality of upwardly extending and inwardly curving fingers.

13. The artificial saguaro cactus of claim 12 wherein each aperture among the multiplicity of apertures is vertically oblongated.

14. The artificial saguaro cactus of claim 13 further comprising at least a first brace rigidly supporting the at least first cactus arm sheet's inner surface.

15. The artificial saguaro cactus of claim 14 wherein the at least first brace comprises a plurality of outwardly extending pleat supporting points.

16. The artificial saguaro cactus of claim 15 wherein the saguaro cactus trunk indicating column comprises at least a first vertically pleated and cylindrically formed cactus trunk sheet.

17. The artificial saguaro cactus of claim 16 further comprising a second multiplicity of apertures extending through the cactus trunk sheet, the second multiplicity of apertures being arranged in a second plurality of vertically extending series of apertures, said series of apertures defining the cactus trunk sheet's vertical pleats.

18. The artificial saguaro cactus of claim 17 wherein each aperture among the second multiplicity of apertures is vertically oblongated.

* * * * *